United States Patent [19]

Ginsburgh

[11] 4,263,969

[45] Apr. 28, 1981

[54] FLAME FRONT CONTROL IN UNDERGROUND COMBUSTION

[75] Inventor: Irwin Ginsburgh, Morton Grove, Ill.

[73] Assignee: Standard Oil Company (Indiana), Chicago, Ill.

[21] Appl. No.: 46,013

[22] Filed: Jun. 6, 1979

[51] Int. Cl.[3] ..... E21B 43/243; E21B 47/10

[52] U.S. Cl. ..... 166/251; 166/259; 299/2

[58] Field of Search ..... 166/251, 256, 259, 260, 166/258; 299/2, 13

[56] References Cited

U.S. PATENT DOCUMENTS

| | | | |
|---|---|---|---|
| 3,111,986 | 11/1963 | Kuhn, Jr. | 166/256 |
| 3,138,202 | 6/1964 | Ewing et al. | 166/256 |
| 3,499,489 | 3/1970 | Parker | 166/258 |
| 4,047,760 | 9/1977 | Ridley | 166/259 X |
| 4,118,070 | 10/1978 | French et al. | 166/251 X |
| 4,120,354 | 10/1978 | Ridley et al. | 166/251 |
| 4,162,808 | 7/1979 | Kvapil et al. | 299/2 |
| 4,181,361 | 1/1980 | Ridley et al. | 166/259 X |

FOREIGN PATENT DOCUMENTS 812573 9/1951 Fed. Rep. of Germany .

*Primary Examiner*—Stephen J. Novosad
*Attorney, Agent, or Firm*—Frank J. Sroka; William T. McClain; William H. Magidson

[57] ABSTRACT

Disclosed is a method and apparatus for controlling flame front advance in underground combustion of hydrocarbonaceous material by passing an oxidizing gas into the combustion area comprising providing a plurality of gas removal means positioned so that gas can be removed in the direction of the desired flame front advance; detecting flame front position in the combustion area; selectively removing gas from the retorting area in response to the detected flame front position through one or more of the gas removal means; so that flow of gas to portions of the flame front can be controlled, thereby controlling the advance of portions of the flame front in the desired manner. This method is especially useful in the underground in situ retorting of oil shale.

13 Claims, 1 Drawing Figure

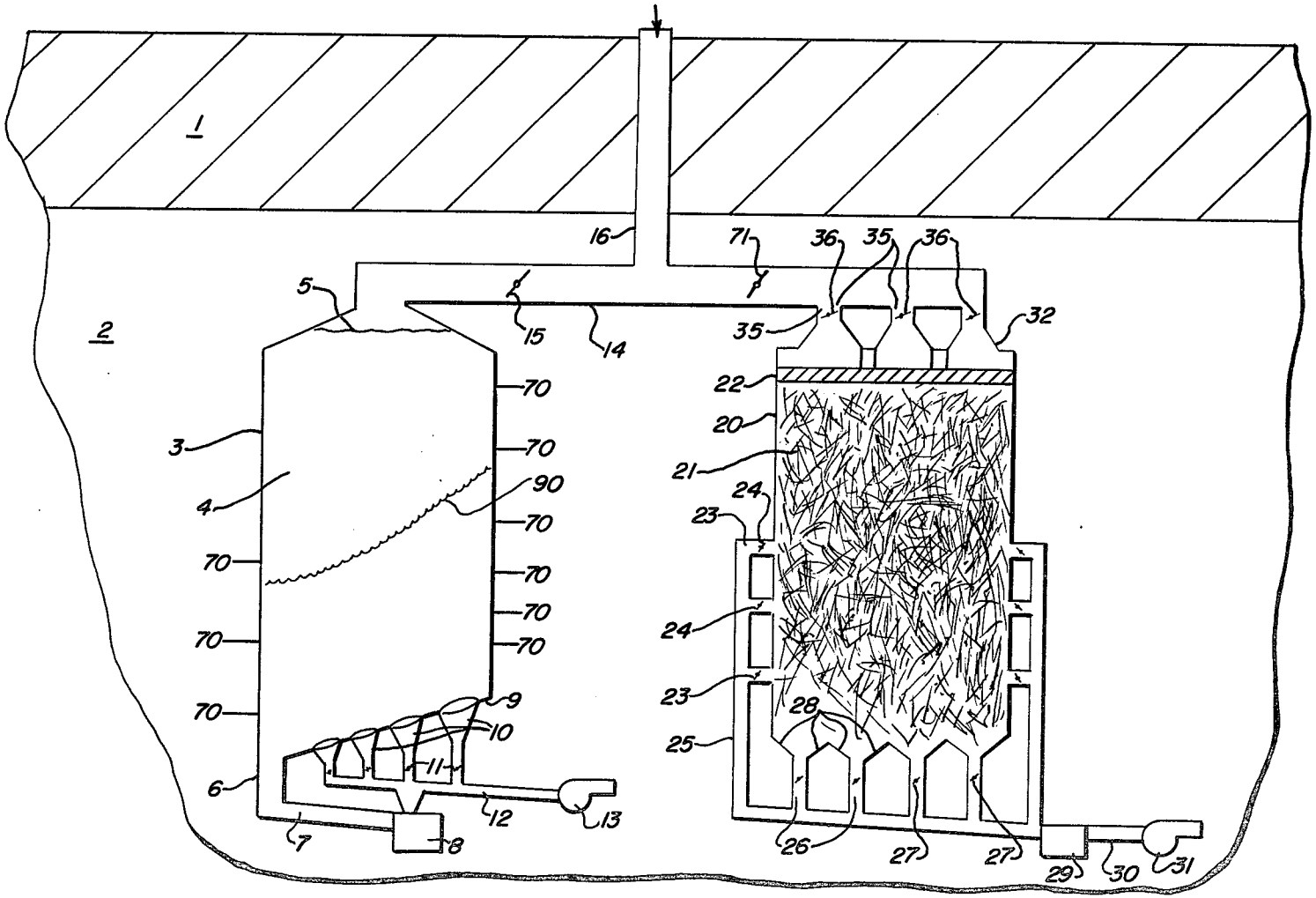
1
2
3
4
5
6
7
8
9
10
11
12
13
14
15
16
20
21
22
23
24
25
26
27
28
29
30
31
32
35
36
70
71
90

FLAME FRONT CONTROL IN UNDERGROUND COMBUSTION

BACKGROUND

This invention relates to recovery of carbonaceous materials from underground deposits. More specifically, this invention relates to the control of flame front advance in the underground combustion or retorting of hydrocarbonaceous materials.

Numerous hydrocarbonaceous materials are found in underground deposits; for example, crude oil, coal, shale oil, tar sands, and others. One method of recovering energy or hydrocarbon from such underground deposits is by underground combustion. An oxidizing gas such as air, sometimes in conjunction with diluents such as steam, can be provided to an underground combustion or retorting zone so as to combust a portion of the combustible material contained therein and either free hydrocarbon or thereby form materials which are suitable for energy recovery. For example, oxygen or air, and possibly steam, can be passed into a coal deposit so as to form off-gases having combustible materials such as light hydrocarbons and carbon monoxide. These gases can then be combusted directly for heat, or energy recovered such as through power generation. Underground combustion can be used in the recovery of petroleum crude oil from certain types of deposits. Air or oxygen, and steam, is passed into an underground deposit and combustion initiated so hot combustion gases will aid in the recovery of such crude oil. Similar technique can be used in the recovery of oil from tar sands. One important use of underground combustion is in the recovery of oil from oil shale.

The term "oil shale" refers to sedimentary deposits containing organic materials which can be converted to shale oil. Oil shale can be found in various places throughout the world, especially in the United States in Colorado, Utah, and Wyoming. Some especially important deposits can be found in the Green River formation in the Piceance Basin, Garfield and Rio Blanco Counties, and northwestern Colorado.

Oil shale contains organic material called kerogen which is a solid carbonaceous material from which shale oil can be produced. Commonly oil shale deposits have variable richness or kerogen content, the oil shale generally being stratified in horizontal layers. Upon heating oil shale to a sufficient temperature, kerogen is decomposed and a liquid is formed. Oil shale can be retorted to form hydrocarbon either in situ or by surface retorting. In surface retorting, oil shale is mined from the ground, brought to the surface, and placed in vessels where it is contacted with hot materials, such as hot shale or gases, for heat-transfer. Hot retorting temperatures cause shale oil to be freed from the rock. Spent retorted oil shale which has been depleted in kerogen is removed from the reactor and discarded. Some well known methods of surface retorting are the Tosco, Lurgi, and Paraho processes.

Another method of retorting oil shale is the in situ process. In situ retorting of oil shale generally comprises forming a retort or retorting zone underground, preferably within the oil shale zone. The retorting zone can be formed by mining an access tunnel to or near the retorting zone and then removing a portion of the oil shale deposit by conventional mining techniques. About 2 to about 40 percent, preferably about 15 to about 25 percent, of the oil shale in the retorting volume is removed to provide void space in the retorting area. The oil shale in the retorting volume is then rubblized by well-known mining techniques to provide a retort containing rubblized shale for retorting.

A common method for forming the underground retort is to undercut the deposit to be retorted and remove a portion of the deposit to provide void space. Explosives are then placed in the overlying or surrounding oil shale. These explosives are used to rubblize the shale, preferably forming a volume of rubble having uniform particle size permeated by uniform gas passages. Some of the techniques used for forming the undercut area and the rubblized area are room and pillar mining, sublevel caving, and the like. After the underground retort is formed, the mass of rubblized shale is subjected to retorting. Hot retorting gases are passed through the rubblized shale to effectively form and remove liquid hydrocarbon from the oil shale. This is commonly done by passing a retorting gas such as air or air mixed with steam and/or hydrocarbons through the deposit. Most commonly, air is pumped into one end of the retort and a fire or flame front initiated by use of a burner or the addition of hydrocarbon such as natural gas, propane, and the like. Heating causes shale oil to be formed from kerogen in the oil shale, leaving coke on or in the oil shale. Combustion is maintained by the burning of coke on spent or partially spent oil shale, thereby producing hot off-gases suitable for retorting. This flame front is passed or advanced slowly through the rubblized deposit to effect the retorting. It is generally desirable to maintain the flame front uniformly oriented so that no area of the flame front advances substantially ahead of the remaining areas. Most often it is desirable to maintain a planar flame front approximately perpendicular to the desired direction of flame front advance. Not only is shale oil effectively produced, but also a mixture of off-gases from the retorting is also formed. These gases contain hydrogen, carbon monoxide, ammonia, carbon dioxide, hydrogen sulfide, carbonyl sulfide, oxides of sulfur and nitrogen, and low molecular weight hydrocarbons. Generally a mixture of off-gases, water and shale oil are recovered from the retort. This mixture undergoes preliminary separation, commonly by gravity, to separate the gases from the liquid oil and from the liquid water. Off-gases are generally used to preheat a newly formed retort, recycled to a burning retort to act as a diluent or retorting fluid, or burned for power generation or other process heating requirements.

A number of patents describe methods of in situ retorting of oil shale, such as Karrick. L. C., U.S. Pat. No. 1,913,395; Karrick, S. N., U.S. Pat. No. 1,191,636; Uren, U.S. Pat. No. 2,481,051; Van Poollen, U.S. Pat. No. 3,001,776; Ellington, U.S. Pat. No. 3,586,377; Prats, U.S. Pat. No. 3,434,757; Garrett, U.S. Pat. No. 3,661,423; Ridley, U.S. Pat. No. 3,951,456; and Lewis, U.S. Pat. No. 4,017,119 which are hereby incorporated by reference and made a part hereof.

One problem in the underground combustion and retorting of carbonaceous materials such as shale oil deposits is the difficulty in forming and maintaining a uniformly oriented or even flame front. If a portion of the flame front advances more quickly than other portions, large portions of the rubblized matter will be bypassed and will not be effectively retorted and the overall recovery of energy from the deposit will be diminished. This is partially attributable to the difficulty in forming a perfectly uniform rubblized mass with uniform gas passages, and also uniformly passing gas into and out of the retorting area. If a narrow portion of the flame front advances completely through the retorting area, oxidizing gas which is passed into one end of the retort will eventually break through the flame front at the leading position and pass to the off-gas collection system. This will naturally overload the off-gas collection system with oxidizing gas which has not had an opportunity to partake in the combustion process. Therefore, flame front breakthrough can lead to the termination of retorting of an oil shale retort before all of, or even a substantial portion of, the rubblized mass of oil shale is retorted, thereby lowering energy recovery from a retort. Flame front breakthrough can also be dangerous because it can result in a combustible or explosive gas composition in the product recovery zone.

Uren, U.S. Pat. No. 2,481,051, and Cheng Yul Cha, et al., U.S. Pat. No. 4,076,312, teach the use of gas removal means downstream of an in situ oil shale retort for removing off-gases. The figures in these patents show that the gas is removed on a nonselective basis with no attempt whatsoever to selectively draw gases from various points in the retort. There is no teaching or suggestion in these patents that gas can be removed so as to control the position or disposition of the flame front. McCollum U.S. Ser. No. 925,178 now U.S. Pat. No. 4,199,026; Ginsburgh, et al., U.S. Ser. No. 925,176 now U.S. Pat. No. 4,210,867; and Ginsburgh, et al., U.S. Ser. No. 925,177 now U.S. Pat. No. 4,210,868; all filed July 17, 1978, are directed to methods for locating underground combustion. These patent applications are especially directed towards locating the position and disposition of flame fronts advancing through underground in situ oil shale retorts. Ginsburgh, et al., U.S. Ser. No. 925,181 filed July 17, 1978, is directed to a method of controlling the flame front during the in situ combustion of the subterranean carbonaceous material. This patent application teaches locating the position of the flame front and then controlling such flame front through various methods such as the control of gas flowing into the in situ retort. None of the above patent applications teaches or suggests the controlled removal of gases from a retort so as to affect the disposition of a flame front.

It is an object of this invention to provide a method for controlling the flame front advance and position in an underground combustion zone, especially in an underground in situ oil shale retort.

It is an object of this invention to provide a process for the efficient recovery of energy from underground deposits of hydrocarbon so that higher yields of energy can be recovered from a given deposit.

It is an object of this invention to prevent the overloading of off-gas recovery systems attendant to underground combustion processes and preventing dangerous gas compositions in off-gas recovery systems.

It is further an object of this invention to provide a method and apparatus for locating and detecting flame front advance.

SUMMARY OF THE INVENTION

The objects of this invention can be attained by detecting the position of the underground flame front, and selectively withdrawing gas from various positions underground so as to effectively control the flame front. The flow of oxidizing gas can be selectively brought to various areas of the retort thereby enhancing combustion. In another aspect of this invention, combustion quenching gases or materials can be selectively brought to various areas to suppress combustion.

Position or disposition of flame fronts are preferably detected by use of thermocouples, however other techniques and apparatus are described in McCollum, U.S. Ser. No. 925,178, now U.S. Pat. No. 4,199,026; Ginsburgh, et al., U.S. Ser. No. 925,176, now U.S. Pat. No. 4,210,867; and Ginsburgh, et al., U.S. Ser. No. 925,177, now U.S. Pat. No. 4,210,868, all filed July 17, 1978, and all which are hereby incorporated by reference and made a part hereof.

In one embodiment, the invention comprises controlling flame front advance in underground combustion of hydrocarbonaceous material by passing an oxidizing gas into the combustion area. A plurality of gas removal means are positioned so that gas can be removed in the direction of the desired flame front advance, or blocked in the direction of breakthrough. Flame front position in the combustion area is detected; gas is selectively removed from the retorting area in response to the detected flame front position through one or more of the gas removal means; so that flow of gas to portions of the flame front can be controlled, thereby controlling the advance of portions of the flame front in the desired manner. Generally the greater the rate of supply of oxygen to a portion of the flame front, the faster the rate of flame front advance.

In another embodiment, noncombustible gases, such as steam, carbon dioxide, nitrogen, and the like, can be selectively drawn to an area of flame front advance by selective removal of gases by gas removal means. Increase in noncombustible gases to a specific area of the flame front should slow down flame front advance in that area by slowing combustion.

In one specific application, the invention comprises controlling flame front advance in underground retorting of oil shale by passing an oxidizing gas into the retorting zone comprising forming an underground retorting zone containing a rubblized mass of oil shale, said zone having a plurality of gas removal means positioned so that gas can be removed from various retort positions. A flame front is established within the retorting zone by passing an oxidizing gas into such zone, flame front position is detected in the retorting zone, and gas is selectively removed from the retorting zone in response to the detected flame front position by one or more of the gas removal means, so that the flame front position can be controlled.

While prior art processes attempt to provide a gas to quench a point of flame front advance, applicant's process draws oxidizing gas to the point of flame front lag or quench gas to the point of flame front lag. This prevents placing unnecessary pressure on the retort which can lead to leaking of noxious gases. It also can avoid modification of gases passed into the retort. Applicant's process gives more control over the flow of gases in the retort than prior art processes.

The rate of gas removal through gas removal means is controlled so that gas may be selectively removed through one or more specific gas removal means. This can be done conveniently by providing suction to the removal means by a manifold system, controlled by remotely operated valves. The gas removal means for the removal of gases from the retorting zone should have a long effective hydraulic reach, that is the distance upstream of the gas removal means at which gas can be diverted or deflected. In general, this will be 1 to 3 times the diameter of the inlet of the converging section where gas enters such gas removal means. Thus a gas removal means can affect upstream flow before it enters the device.

Generally, the hydraulic reach of the gas removal means should be at least 10 feet through the rubblized mass of oil shale. Preferably the gas removal means has an effective hydraulic reach greater than about 30 feet, still more preferably greater than about 50 feet through the rubblized mass of oil shale. Depending on the size and shape of the underground retort, it may be preferable to have a hydraulic reach greater than about one-twentieth, more preferably about one-tenth of the longest dimension of the retorting zone. The number of gas removal means should be relatively small; each having large diameters so that they can be effective at long distances (that is, 1 to 3 or more diameters upstream).

The gas removal means are effectively disposed in or around the underground retort so that selective removals of fluids, especially gases, can be effected. The gas removal means are generally located in or at the bottom or the sides of the retort. In some cases, the gas removal means can actually be disposed within the retorting zone. However, it is more preferable to have the gas removal means disposed within the underground formation immediately adjacent to the retort boundaries.

Generally the gas removal means comprises a zone having gradual inwardly sloping sides so that gas can enter through a wider portion of the zone and be directed towards a narrower portion of the zone. This type of zone generally has a long effective hydraulic reach because of the large inlet diameter. Such gas removal means can be a conical or pyramidal shaped zone wherein gas passes into a broad open end and passes inwardly to a narrower portion of the means. The conical shape can have a circular or oval cross-section and the pyramidal shaped zone can have three, four, five, six or more sides. In order to have an effective hydraulic reach, the sides or boundaries of the conical or pyramidal shaped means generally slope at least 30° from the longitudinal axis of the zone. Preferably the boundaries slope at least 45° from the longitudinal axis of the conical or pyramidal shaped zone and can even go to 45°. A compressor or fan or pump is commonly used to withdraw gases and form a suction at one end of the gas removal means so as to effectively remove gaseous materials from them. Gases should be removed in such a manner as to give the desired hydraulic reach.

If the gas removal means are under the retort, the gas removal means may also collect liquid product. Since liquid product drops vertically from the retort zone, excess liquid product will drop beneath a zone where breakthrough is occurring. By monitoring the liquid flow in the various gas removal means, the position of a potential breakthrough zone can also be found. Also, by analysis of gas composition and gas volume from a number of the gas removal means, valuable retorting information, including flame front advance rate information can be found. Generally, retorting temperatures, flame front advance rates, etc. are reflected in off-gas composition.

Gas removal means are conveniently constructed or disposed when the retort is formed. Preferably the gas removal means will not allow gas passage or leakage from the retort until gas removal from that position is desired. This can be accomplished by gas-tight bulkheads and valve arrangements.

THE DRAWING

The attached drawing is a schematic representation of the subject invention.

An underground hydrocarbonaceous deposit such as oil shale 2 is found beneath the surface of the earth and covered with overburden 1. Subterranean in situ retorts 3 and 20 are disposed within the oil shale deposit 2.

Retort 3 is filled with a mass of rubblized oil shale 4 contained within the boundaries of the retort. This mass of rubblized shale has been formed by well-known techniques of selective removal of a portion of the deposit and explosive expansion of the deposit to form a uniform rubblized mass of oil shale permeated by relatively uniform gas channels. It is preferred that the rubblization be carried out by sublevel caving or by the crater retreat method of blasting. The retort 3 has an air space 5 above the rubblized mass so as to aid in the distribution of air to be passed into and through the retort. The base of the retort is provided with a sloping floor 9 which leads to drift 6 and 7 for the removal of liquid materials from the retort. Such liquid materials, sometimes in conjunction with gases, are passed to separation zone 8 which may be a sump for preliminary separation of liquids from gases or may be an oil/water/gas separator. Positioned in and below the floor of the retort are gas removal means 10 which are conically shaped and have sloping sides of approximately 45° from the longitudinal axis of such cone. The gas removal means 10 are connected to a fan or pump 13 which can effectively remove gaseous material. Pump 13 and gas removal means 10 are connected by means of a pipe, tunnel or manifold 12 which also drains into sumps. Valves 11 are located within the manifold 12 so as to selectively control the amount of gas which can pass through any given one of the gas removal means 10. An air shaft 16 is provided through the overburden which connects to a drift 14 for providing air and possibly other retorting fluids and diluents to retorting zone 3. Valve 15 is provided within drift 14 so as to control the flow of gaseous material into the retort. Air, air and steam, air and various diluent retorting fluids, or various retorting fluids can be provided to retort 3 by a fan or compressor which provides the fluids to the top of retort 3 at position 5. Preferably enough gases are removed by pump 13 so as to draw the fluids through the retort from top to bottom, in some cases actually causing a vacuum within the retort. A flame front 90 can be initiated at the top of the retort by passing air into the retort and initiating combustion by well-known means. The flame front 90 causes hot retorting gases to pass downwardly through the retort toward the gas removal means 10 thereby effectively retorting the mass of oil shale and causing liquid and gaseous products and by-products to pass downwardly. The flame front advances through the rubblized volume and causes a burning or combustion of the coke remaining on partially spent retorted oil shale. As the flame front progresses through the retort it can become distorted and not progress evenly. Ideally, the flame front should be relatively planar passing normally to the longitudinal axis of the retort. However, such planar zone may become distorted with one edge or one or more areas advancing more rapidly than others. When any portion of the flame front reaches the bottom of the retort, retorting must be concluded because air passed into the top of the retort would bypass the portions of the rubblized matter which has not been retorted and passed directly to the gas recovery zones at the bottom of the retort. In order to locate the position of the flame front numerous thermocouples 70 have been placed around and throughout the retort. This can be accomplished by placing thermocouples into the retorting zone while rubblization is taking place and also by drilling holes into the periphery of the retorting zone so as to provide insertion areas for such thermocouples and to protect them from overheating. Alternatively the leads for the thermocouples come up from the bottom of the retort, and thermocouple damage only occurs when the flame reaches them. These thermocouples are preferably located around the retort at such positions so as to effectively locate the position and shape of the advancing flame front. When it is determined that the flame front is advancing improperly, valves 11 leading to the gas removal means 10 are controlled so as to remove gas more rapidly from the lagging portions of the flame front so as to increase the amount of oxygen brought to the lagging area and encourage flame front advance at that position. In this case, gas is removed more rapidly from the rightmost gas removal means than from that positioned on the left side of the retort. This causes the flame front to become more planar and will prevent premature flame front breakthrough. Gas removal means will be most effective in controlling the flame front in the bottom half of this type of elongated vertical retort.

Retort 20 is located within the subterranean deposit 2 and is filled with a mass of rubblized matter such as oil shale. The retort has also been formed by well-known techniques as described for retort 3. Atop the mass of rubblized matter 21 is an unmined portion of the deposit 22 which contains perforations. This sill pillar 22 uses the well-known engineering principle of pressure drop so as to effectively disperse air and gases into the top of the retort. Retorting gases such as air, air and steam, air and diluent materials can be passed through air access tunnel 16 and drift 14 and controlling valve 71 through access tunnels 35 and control valves 36 into room 32 above the retort. The gases from there pass through the sill pillar 22 at various perforations and into the mass of rubblized oil shale 21. Tunnels 35 and valves 36 control the flame front in the top half of the retort. The hydraulic reach of the gas inlets is downstream of the inlets. The injection of flue gas into a specific tunnel 35 will reduce combustion directly below that tunnel and thus can be used in this mode rather than just denying oxygen to part of the flame front. This minimizes the flow of oxygen into the retort below tunnel 35. Along the sides of the retort are located drifts 23 through which gases can be added or removed at various lateral areas of the retort. Valves 24 are provided so that the amount of gases or the amount of vacuum applied at any given portion of the retort can be controlled. Gases removed from tunnels 23 are passed through tunnel 25 to sump area 29. At the bottom of the retort are located various pyramidal gas and liquid removal means 28. These gas and liquid removal means 28 have slanting sides leading to tunnels 26 and connected to sump 29. Valves 27 are located within holes 26 so as to selectively control the amount of materials which can be drawn through the tunnels 26. The sump 29 is connected by tunnel 30 to a pump or fan 31 for the removal of gases and/or liquid. Preferably pump 31 can effectively remove gases at such a rate as to draw gases through retort 20, especially in a selective manner through the various tunnels and holes 24 and gas removal means 28 so as to control flame front in a manner described for retort 3. Liquid flow measuring means in tunnels 27 or gas flow measuring means in tunnels 26 can aid in detecting the location of a potential breakthrough zone.

If oxygen breakthrough occurs and oxygen concentration exceeds 8%, accidental combustion may occur in the vent system. The use of a pilot flame at the bottom of the retort can combust the oxygen or reduce its concentration.

I claim:

1. A method for controlling flame front advance in underground retorting of oil shale by passing an oxidizing gas into a retorting zone comprising:

forming an underground retorting zone containing a rubblized mass of oil shale;

providing a plurality of gas removal means positioned so that gas can be removed in the direction of desired flame front advance;

establishing a flame front within the retorting zone by passing an oxidizing gas into such zone;

detecting flame front position in the combustion area;

selectively removing gas from the retorting area in response to the detected flame front position through one or more of the gas removal means; so that flow of gas to portions of the flame front can be controlled, thereby controlling the advance of portions of the flame front in the desired manner.

2. A method for controlling flame front advance in underground retorting of oil shale by passing an oxidizing gas into the retorting zone comprising forming an underground retorting zone containing a rubblized mass of oil shale, said zone having a plurality of gas removal means positioned so that gas can be removed from various retort positions;

establishing a flame front within the retorting zone by passing an oxidizing gas into such zone;

detecting flame front position in the retorting zone; and selectively removing gas from the retorting zone in response to the detected flame front position by one or more of the gas removal means; so that the flame front position can be controlled.

3. The method of claim 2 wherein the gas removal means has a hydraulic reach greater than about one twentieth of the longest dimension of the retorting zone.

4. The method of claim 3 wherein the gas removal means has a hydraulic reach greater than about one tenth of the longest dimension of the retorting zone.

5. An underground oil shale retort containing rubblized shale, in association with a flame front position detection means and more than one gas removal means disposed in or at the bottom or the sides of the retort, said gas removal means comprising zones having large inwardly sloping boundaries so that said means will have a long effective hydraulic reach, operatively connected so that the gas removal means can be operated in response to the detection means and selectively remove fluids from the retort and control flame front advance.

6. The retort of claim 5 wherein the gas removal means has an effective hydraulic reach of greater than about 10 feet through the rubbllized oil shale.

7. The retort of claim 6 wherein the gas removal means has an effective hydraulic reach of greater than about 30 feet through the rubblized oil shale.

8. The retort of claim 7 wherein the gas removal means has an effective hydraulic reach greater than about 50 feet through the rubblized oil shale.

9. The retort of claim 5 wherein the gas removal means comprises conical or pyramidal shaped zones and has a broad open end so that fluid passes inwardly at the broad end.

10. The retort of claim 5 wherein the gas removal means boundaries slope at least about 30 degrees from the longitudinal axis of the conical or pyramidal shaped zone.

11. The retort of claim 10 wherein the gas removal means boundaries slope at least about 45 degrees from the longitudinal axis of the conical or pyramidal shaped zone.

12. The retort of claim 5 wherein the gas removal means is disposed at the sides and the bottom of the retort.

13. A method for controlling flame front advance in underground retorting of oil shale comprising forming an underground retorting zone containing a rubblized mass of oil shale, said zone having a plurality of gas removal means positioned at the bottom and sides of the retorting zone so that gas can be removed from various retort positions;

establishing a flame front within the retorting zone by passing an oxidizing gas into such zone;

detecting flame front position in the retorting zone; and selectively removing gas from the retorting zone in response to the detected flame front position by one or more of the gas removal means; so that the flame front position can be controlled.

* * * * *